US005595504A

United States Patent [19]

Muller

[11] Patent Number: 5,595,504

[45] Date of Patent: Jan. 21, 1997

[54] SEALED CONNECTOR

[75] Inventor: Mark W. Muller, Fort Worth, Tex.

[73] Assignee: Siecor Corporation, Hickory, N.C.

[21] Appl. No.: 313,513

[22] Filed: Sep. 26, 1994

[51] Int. Cl.[6] ..... H01R 13/52

[52] U.S. Cl. ..... 439/521; 439/936

[58] Field of Search ..... 439/521, 936, 439/204, 587, 278

[56] References Cited

U.S. PATENT DOCUMENTS

| | | | |
|---|---|---|---|
| 4,500,158 | 2/1985 | Dola . | |
| 4,588,238 | 5/1986 | Mickelson et al. . | |
| 4,666,225 | 5/1987 | Hampton et al. . | |
| 4,749,359 | 6/1988 | White | 439/133 |
| 4,789,348 | 12/1988 | Hampton | 439/142 |
| 4,824,390 | 4/1989 | Crane et al. | 439/271 |
| 5,111,497 | 9/1990 | Bliven et al. | 379/27 |
| 5,195,125 | 3/1993 | Bliven et al. | 379/29 |
| 5,246,383 | 9/1993 | Shimirak et al. | 439/936 X |
| 5,376,019 | 12/1994 | Shimirak et al. | 439/521 OR |
| 5,427,547 | 6/1995 | Shimirak et al. | 439/521 OR |
| 5,429,697 | 7/1995 | Lilinethal, II et al. | 439/936 X |

*Primary Examiner*—P. Austin Bradley
*Assistant Examiner*—Daniel Wittels
*Attorney, Agent, or Firm*—Wesley T. Noah

[57] ABSTRACT

A sealed RJ-11 connector includes plug and connector entrances each comprises a material insert molded to both sides of a plate. At least one such material is sufficiently flexible to expand or contract responsive to air pressure, and a gel may be used to seal at least one of the entrances.

5 Claims, 6 Drawing Sheets

43
51
50
52
53

SEALED CONNECTOR

BACKGROUND OF THE INVENTION

The field of the invention is environmentally protected electrical jacks and plugs. Known to the art is the desirability of protecting electrical jacks and plugs, such as a standard RJ11 modular connector, from environmental contamination to enable them to be used outdoors as components in network interface devices or other articles. Dust covers provide one means of protection. For example, U.S. Pat. No. 4,789,348 describes a unitary dust cover protecting an electrical jack and plug.

U.S. Pat. No. 4,588,238 describes another environmentally sealed RJ-11 connector. Holes providing passage for wires at the back of the connector and for the line entering the plug at the front of the connector are each sealed with a polyurethane resin, and the mating surfaces between the faces of the plug and the jack are sealed by a rubber sealing member. However, it is then necessary to provide a spring retaining clip to maintain compression on the rubber sealing member.

U.S. Pat. Nos. 5,111,497 and 5,195,125 describe environmental sealing of an RJ11 connector by partially filling the jack socket with a gel. Alternatively, gel can be placed in a trench around the jack or within a cap around the plug. A disadvantage which has arisen in the use of sealed RJ11 connectors has been seen during variations in temperature, in that free spaces within the connector, which are never entirely eliminated, can be at a pressure different from the surrounding atmosphere due to material expansion and the like. Over time, such differences in pressure can lead to connector degradation by drawing in moisture.

One class of devices employing RJ11 connectors is network interface devices, which are devices connected between a telephone network provider's central office and the premise wiring of a telephone subscriber. Means in the network interface device allow connection and disconnection between terminals connected to the subscriber's premise wiring and terminals connected to the telephone company's central office. U.S. Pat. No. 4,749,359 gives further description of the layout of a network interface device and is incorporated herein by reference.

Objects of the invention are to provide an environmentally sealed RJ11 connector which passes Bellcore specification TR-NWT-000049 with better sealing than provided by a dust cover, elimination of the spring clip to allow normal snap-latch operation of the plug, and a less costly, more efficient design than that provided by the prior art.

SUMMARY OF THE INVENTION

The improved RJ11 connector according to the invention is provided with a thin layer of silicone rubber resin insert molded onto both sides (major surfaces) of a back plate having a plurality of holes therein allowing the silicone rubber to join to itself during the molding process. Some surface areas of the back plate do not have silicone rubber molded thereover, allowing ultrasonic welding of the back plate to a connector housing. Such ultrasonic welding acts to compress the silicone rubber against the housing, sealing the conductor entrance. Four small holes in the back plate allow metallic conductors to be pushed through the back of the connector through the silicone rubber layer, the silicone rubber being sufficiently elastic to urge itself against the conductor insulation. The back plate has a larger diaphragm hole, over which the major surfaces of the rubber are advantageously provided with a surface area greater than the area delimited by the diaphragm hole perimeter, allowing such rubber surfaces to act as a diaphragm, expanding and contracting to compensate for differences between external and internal air pressure while preserving its seal with the housing. In the preferred embodiment, such rubber surface is fashioned with a central corrugated area having a "bull's-eye" appearance.

The front or plug end of the connector is provided with a thin silicone rubber boot thereover, with the area around the plug and line cord and within the boot filled with a silicone gel. The boot is insert molded over both sides (major surfaces) of a front plate which is ultrasonically welded to the plug, with the boot and front plate having a passage through which the line cord passes to the plug. A raised rib on the exterior surface of the housing around the plug entrance presses into the gel upon insertion of the plug to provide a secure environmental seal.

Minimal contact force to make and maintain the gel seal, pressure equalization within the plug and jack cavity, and the use of durable, flexible silicone materials ensure that the connector according to the invention can meet the requirements of an outdoor installation.

DETAILED DESCRIPTION OF THE PREFERRED EMBODIMENT

Figure 1:
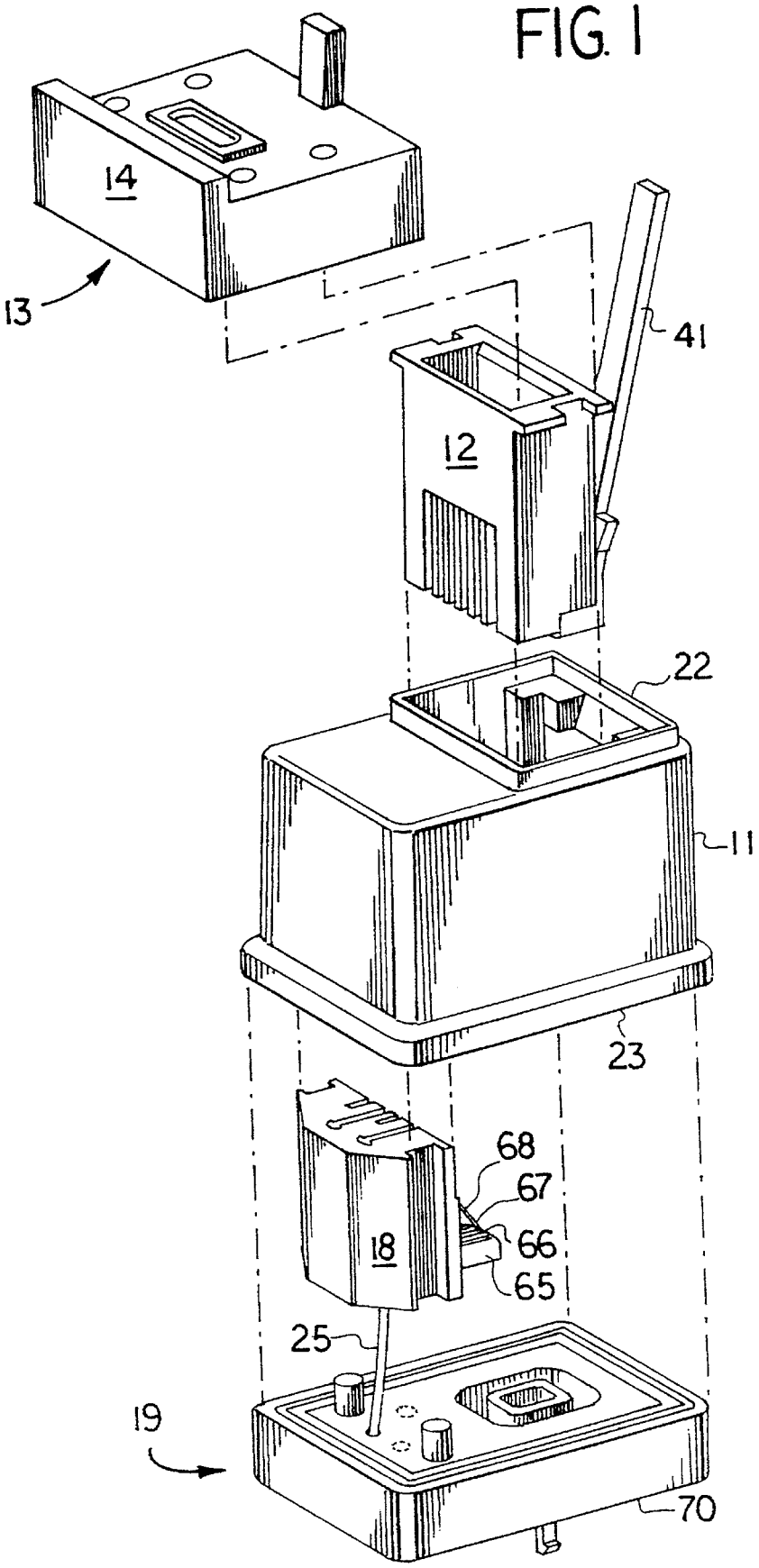
FIG. 1 is an exploded view of the connector of FIG. 2.
Figure 2:
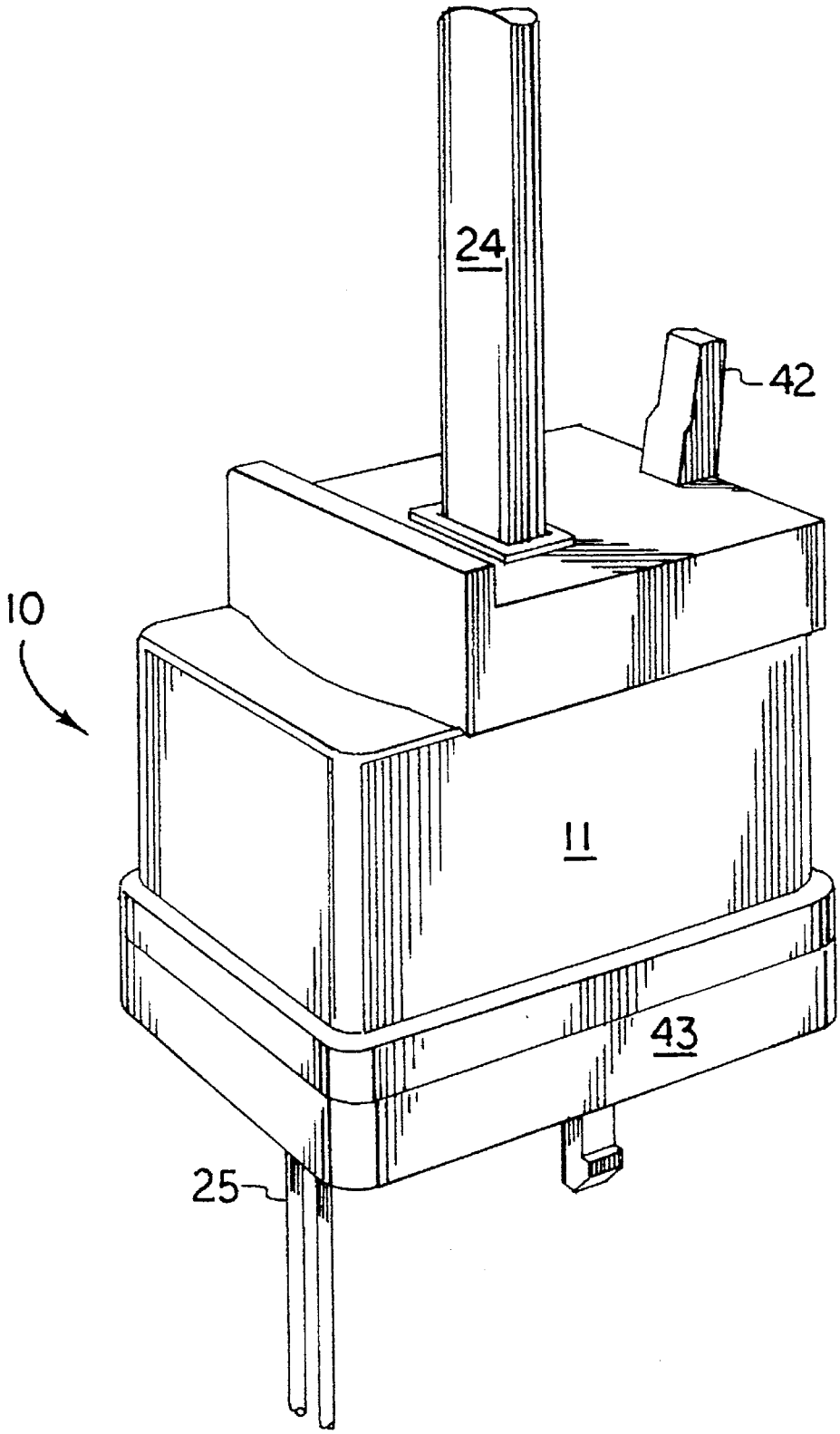
FIG. 2 is a perspective view of the improved connector.

The assembled connector 10 is shown in FIG. 2, and components of connector 10, showing only some wiring for greater clarity, are shown in FIG. 1. Connector 10 comprises a plastic jack housing 11, which is molded from polyethersulfone material. Jack housing member 11 has a plug entrance delimited by its raised rib 22, and member 11 also has a conductor entrance 23. Connector 10 further comprises a plug 12, which is molded from polyethersulfone; plug sealing member 13, which comprises a thin silicone rubber "boot" 14 insert molded over polyethersulfone second plate 16, member 13 further sealed by gel 17. Dielectric member 18 has integral dielectric extensions 65,66,67 for separating tips 68 of electrical wires 25, only one of which is shown for clarity, extensions 65,66,67 projecting substantially perpendicular to the direction (down, in the drawing) from which electrical wires 25 enter dielectric member 18. Conductor sealing member 19 comprises thermoset silicone rubber insert molded to both sides of polyethersulfone first plate 43. First plate 43 is ultrasonically welded to housing member 11. Conductor wires 25 enter conductor sealing member 19 from side 70.

As shown in FIG. 2, assembled connector 10 further comprises line cord 24 which proceeds through plug sealing member 13 and terminates in exposed electrical conductor wires (well known to the prior art and not shown for clarity) arranged in plug 12. Insulated conductors 25 proceed through conductor sealing member 19 and terminate in exposed electrical conductor wires 68 arranged in dielectric member 18. When plug 12 is inserted, the conductor wires from line cord 24 in plug 12 establish electrical connection with the conductor wires 68 from insulated conductors 25 in dielectric member 18. This wiring scheme is well known to those of ordinary skill in the art and is thus not further shown in the drawings.

Figure 4:
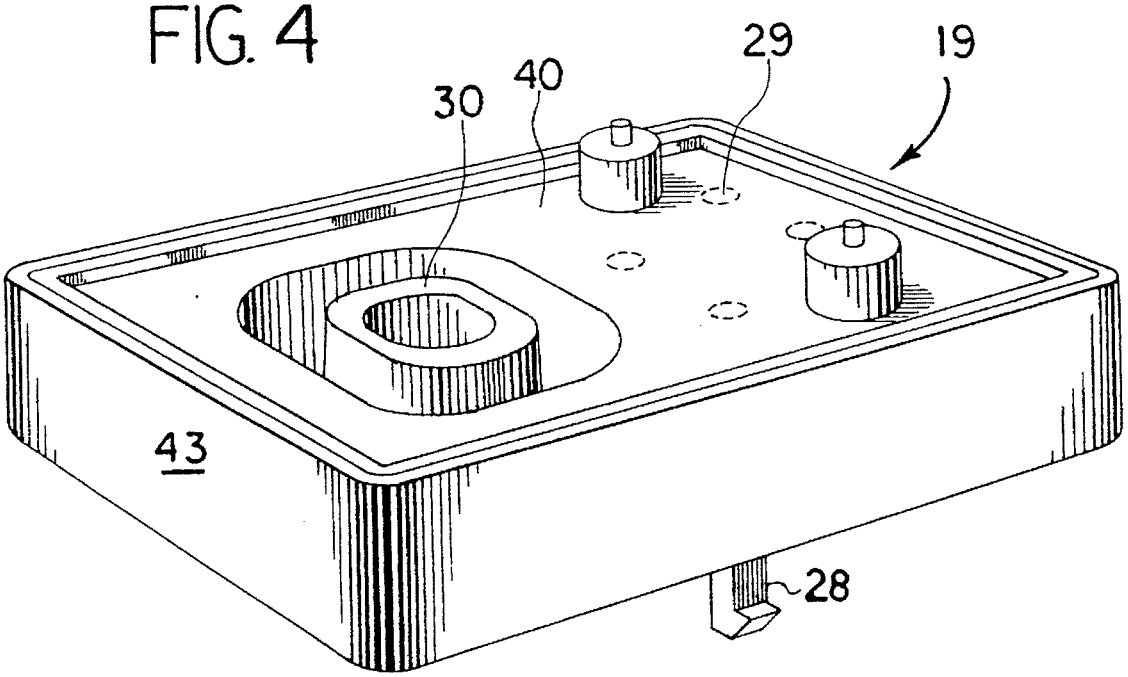
FIG. 4 is a perspective view of the back plate and resin.
Figure 7:
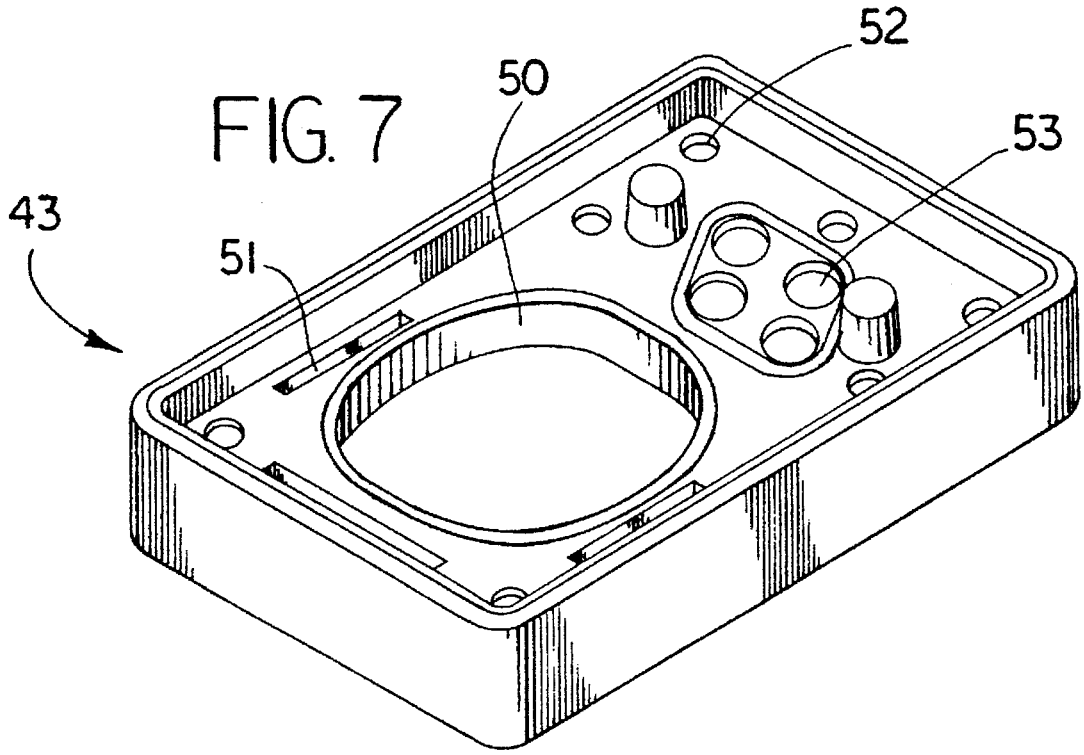
FIG. 7 is a perspective view of the back (first) plate.

Details of conductor sealing member 19 will now be set out in further detail. As shown in FIG. 7, polyethersulfone first plate 43 includes conductor entrance holes 53, diaphragm hole 50, and circumferential holes and slots 51,52 used in insert molding. Connector mounting posts 28 are integral to side 70 of first plate 43 (seen in FIG. 4). A thin, flexible thermosetting silicone rubber resin is insert molded onto both major surfaces of plate 43 through holes and slots 50,51. Holes and slots 50, 51, 52 pass from one major surface (not in view) to the other (in view). The resin includes a first portion 40 covering the area around conductor holes 53 and a second portion 30 over diaphragm hole 50 having major surfaces (oriented upward and downward in the orientation of the drawings) which have surface areas greater than the area bounded by hole 50, thereby enabling resin portion 30 to expand or contract responsive to air pressure within housing 11. Resin portion 29 covering holes 53 is sufficiently thin that conductors 25 may be pushed through without difficulty.

Figure 3:
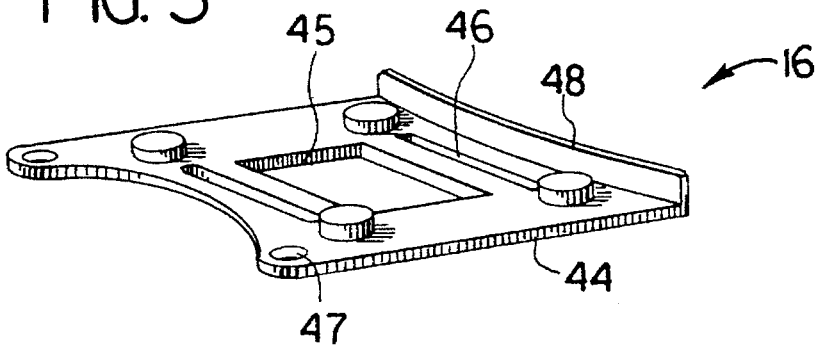
FIG. 3 is a perspective view of the front (second) plate.
Figure 6A:
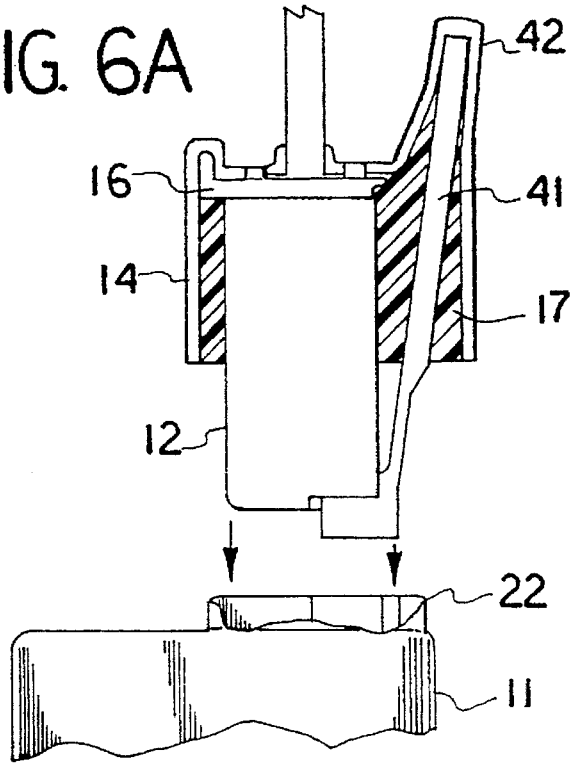
FIG. 6A is a side view of a sealed plug entering the housing.
Figure 6B:
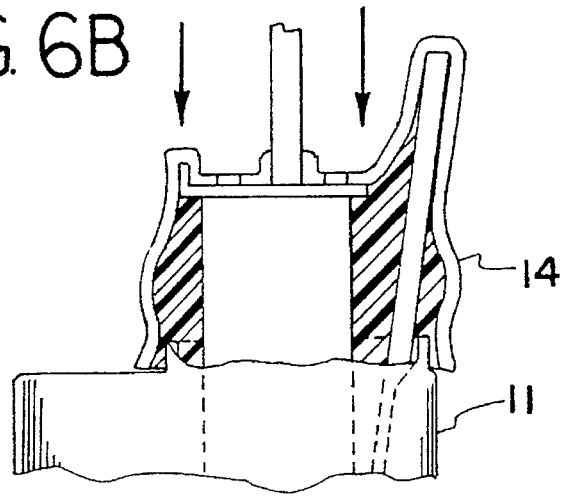
FIG. 6B is a side view of a sealed plug on the housing.

Plug sealing member 13 is further set out in FIGS. 6A, 6B. RJ11 plug 12 has a standard latching arm 41. Plug sealing member 13 includes a second plate 16 having hole 45 to accommodate passage of line cord 24, holes 47 and slots 46 through which plastic 14 is insert molded, and ledge 48 for supporting plastic 14. Holes 47 and slots 46 pass between the major surfaces (oriented up and down in FIG. 3 of second plate 16. Plastic 14 further contains gel 17 for sealing plug entrance 22. Plug 12 is shown before mounting in FIG. 6A, and after mounting in FIG. 6B.

A preferred silicone dielectric gel for use in the invention has uncured properties at room temperature of a viscosity of 750 cps, a specific gravity of 0.98, and a pot life of 30 minutes; and cured properties of a penetration value of 6.0 mm at room temperature, a refractive index of 1.41, and a useful temperature range of −50 to 204 deg. C.

Figure 5:
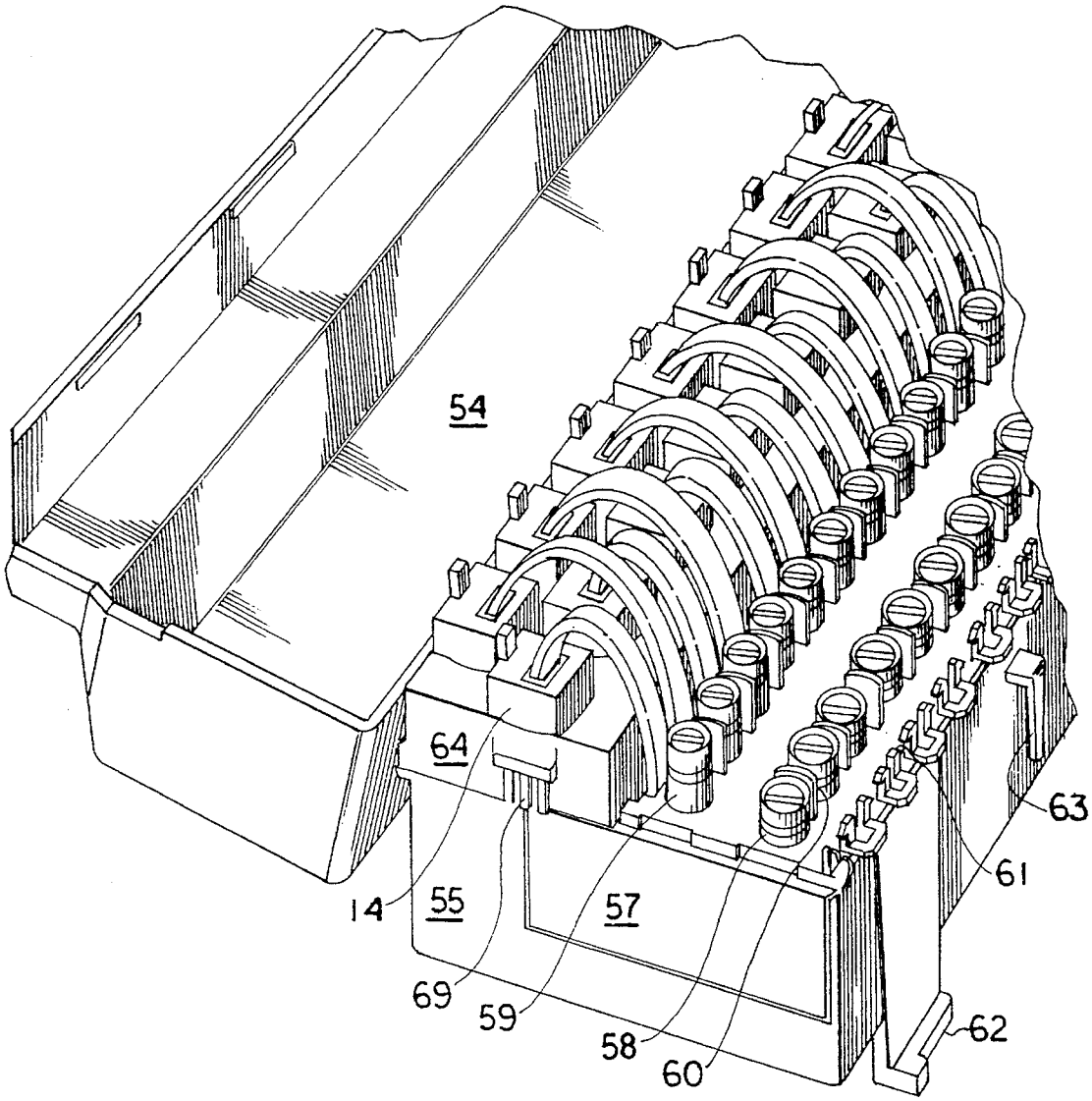
FIG. 5 is a partial perspective view of a multi-line network interface device accommodating a plurality of sealed connectors.

A multi-line network interface device containing the sealed connectors is shown in FIG. 5. Housing 55 has mounting supports 62, retaining members such as 63, and dielectric tray 57 containing subscriber terminals 58,59 for connection to subscriber premises wiring. Terminals 58,59 are connected to underlying terminals connected by line cords to a plurality of sealed connectors each covered by a plastic 14. The sealed connectors are set in plastic tray 64, which includes hinges to support cover 54. Separate back plate members 69 are ultrasonically welded to tray 64 by three posts on each side of each member 69. The sealed connectors are connected underneath to wiring which exits to a cable which exits from the back of the network interface device adapted for connection to telephone company wiring.

What is claimed is:

1. A sealed connector, comprising:

a jack housing enclosing a dielectric member holding electrical contacts, the jack housing having a plug entrance and a conductor entrance;

an electrical plug removably insertable into the jack housing through the plug entrance and attached at a first plug end to a line cord, the plug having a second plug end opposite the first plug end, and having a latching arm that extends from the second plug end and toward the first plug end;

a resilient boot attached to the first plug end and extending out over the first plug end and the latching arm and then toward the second plug end sufficiently such that the boot abuts against the jack housing when the plug is inserted into the jack housing so as to define a closed space around the portion of the plug and the latching arm extending from the jack housing, the boot sufficiently resilient to allow manipulation of the latching arm through the boot, the boot defining a hole for passage of the line cord to the plug;

a resin having major surfaces covering the conductor entrance, the resin having a first portion and a second portion, at least the second resin portion sufficiently flexible to expand or contract responsive to air pressure within the jack housing; and electrical conductors inserted through the first resin portion and extending to the dielectric member.

2. A sealed connector as recited in claim 1 wherein the resin is a unitary member insert molded onto a first plate.

3. A sealed connector as recited in claim 1 wherein the major surfaces of the second resin portion have surface areas greater than the area delimited by a hole in the first plate which is covered by the second resin portion.

4. The sealed connector of claim 1 further comprising a gel disposed in the boot and around the portion of the plug and the latching arm in the boot.

5. The sealed connector of claim 1 further comprising a boot plate to which the boot is attached, the boot plate attached to the first plug end of the plug and defining a hole therethrough for passage of the line cord.

* * * * *